United States Patent [19]

Akao et al.

[11] 4,137,515

[45] Jan. 30, 1979

[54] SYNTHETIC RESIN PACKED COIL ASSEMBLY

[75] Inventors: Masatake Akao, Katano; Yoshikazu Yokose, Takarazuka; Kazuo Yamashita; Takashi Shibano, both of Kawanishi, all of Japan

[73] Assignee: Matsushita Electric Industrial Co., Ltd., Osaka, Japan

[21] Appl. No.: 851,588

[22] Filed: Nov. 14, 1977

Related U.S. Application Data

[63] Continuation-in-part of Ser. No. 615,082, Sep. 19, 1975, abandoned.

[30] Foreign Application Priority Data

| | | | |
|---|---|---|---|
| Sep. 19, 1974 | [JP] | Japan | 49-108528 |
| Sep. 19, 1974 | [JP] | Japan | 49-108529 |
| Sep. 19, 1974 | [JP] | Japan | 49-108530 |
| Sep. 19, 1974 | [JP] | Japan | 49-108531 |
| Sep. 19, 1974 | [JP] | Japan | 49-108532 |
| Sep. 19, 1974 | [JP] | Japan | 49-108533 |
| Sep. 20, 1974 | [JP] | Japan | 49-109098 |
| Jan. 14, 1975 | [JP] | Japan | 50-6565 |
| Apr. 17, 1975 | [JP] | Japan | 50-47030 |

[51] Int. Cl.[2] ..... H01F 15/04; H01F 27/30

[52] U.S. Cl. ..... 336/84 C; 336/205; 336/209

[58] Field of Search ..... 336/205, 206, 209, 84 R, 336/84 C, 96; 310/208

[56] References Cited

U.S. PATENT DOCUMENTS

| | | | |
|---|---|---|---|
| 2,489,867 | 11/1949 | D'Orio | 336/205 X |
| 2,656,290 | 10/1953 | Berberich et al. | 336/205 X |
| 3,119,085 | 1/1964 | Tiejema | 336/205 X |
| 3,292,127 | 12/1966 | Dormaier | 336/209 |
| 3,297,970 | 1/1967 | Jones | 336/205 |
| 3,308,414 | 3/1967 | Ostrander et al. | 336/205 |
| 3,414,856 | 12/1968 | Guilbault et al. | 336/205 |
| 3,462,544 | 8/1969 | King | 336/205 X |
| 3,742,411 | 6/1973 | Hill | 336/205 X |
| 3,845,438 | 10/1974 | Mendelsohn et al. | 336/209 |
| 3,870,982 | 3/1975 | Shibano et al. | 336/205 |
| 3,960,803 | 6/1976 | Smith et al. | 336/205 |

*Primary Examiner*—Thomas J. Kozma

*Attorney, Agent, or Firm*—Wenderoth, Lind & Ponack

[57] ABSTRACT

A synthetic resin packed coil assembly formed by a wound spiral of a number of bundled turns of insulated wire comprises at least one layer enveloping the bundled turns of insulated wire of the wound spiral. This layer is composed of a synthetic resin reinforced by a high strength fibrous material and is formed by first winding the high strength fibrous material around the bundled turns of insulated wire of the wound spiral, subsequently impregnating a solution of the synthetic resin and finally allowing the synthetic resin to harden.

9 Claims, 14 Drawing Figures

SYNTHETIC RESIN PACKED COIL ASSEMBLY

This application is a continuation-in-part of Ser. No. 615,082, now abandoned, filed Sept. 19, 1975.

The present invention relates to a synthetic resin packed coil assembly for use in an electric circuit.

A synthetic resin packed coil assembly to which the present invention pertains is not itself novel. As shown in FIGS. 1 and 2 of the accompanying drawings, which are respectively a perspective view of a prior art coil assembly of a similar kind and a cross sectional view thereof taken along the line II—II in FIG. 1, the prior art coil assembly comprises a wound spiral 1 having a plurality of turns 2 of insulated wire, made of electric conductive material such as copper, iron or aluminum, having the opposite ends formed into leads 4 for external electric connection, which wire turns 2 represent, as best shown in FIG. 2, a bundled configuration in section. The wire turns 2 of the wound spiral 1 are externally covered with a layer of synthetic resin 3 of electrically insulating property by means of an injection molding technique or a plastic die casting technique.

However, it has been found that, during the use of the prior art coil assembly of the above construction in an external electric circuit, internal stress set-up occurs in the resin layer 3 due to the difference in thermal expansion coefficient between the synthetic resin for the layer 3 and material for the wire of the wound spiral 1 and, therefore, in most cases, the internal stress set-up results in formation of cracks in the resin layer 3 which leads to a substantial malfunction of the coil assembly or otherwise insufficient performance of the same.

This drawback may be removed by employing a synthetic resin for the layer 3 which contains a relatively large amount of inorganic powdery filler which is added thereto in order for the thermal expansion coefficient of the resin layer 3 to be equalized, or approximated to that of the electric wire of the wound spiral 1. Although this may result in relief of the internal stresses which may otherwise be set up in the layer 3 by the difference in thermal expansion coefficient, the physical strength of the layer 3 is adversely affected to an extent that the resultant coil assembly can no longer withstand a relatively high electric load. Moreover, the use of the synthetic resin, to which the inorganic powdery filler has been added, for the layer 3 does not completely remove a possibility of formation of cracks in the layer 3 and, therefore, the resultant coil assembly is liable to a substantial malfunction or, otherwise, reduction in performance.

Considering a manufacturing process, the addition of the inorganic powdery filler to the synthetic resin for the layer 3 causes an increase of the viscosity of such synthetic resin in molten state and, therefore, impregnation and injection-molding with the wound spiral 1 requires a relatively long time. Moreover, during the impregnation, voids tend to develop and the resultant layer 3 will not exhibit a desired or required electric property.

In general, the respective thermal expansion coefficients of the electric wire for the spiral 1 and the synthetic resin for the layer 3 may be substantially equal to each other if the temperature evolved in the coil assembly durng the use in an external electric circuit is lower than the heat distortion temperature of the synthetic resin for the layer 3, that is, the temperature at which heat distortion takes place in the layer 3. However, where the temperature evolved in the coil assembly is higher than the heat distortion temperature, the thermal expansion coefficient of the synthetic resin for the layer 3 increases on one hand and the thermal expansion coefficient of the electric wire for the wound spiral 1 remains substantially the same and, therefore, the difference in thermal expansion coefficient results in a considerable stress set-up in the layer 3. Because of the above reason, the prior art coil assembly lacks a sufficient resistance to cracking with a consequent reduction in temperature resistance.

Accordngly, the present invention has for its essential object to provide an improved synthetic resin packed coil assembly, which substantially eliminates the drawbacks inherent in the prior art coil asemblies of a similar kind.

Another object of the present invention is to provide an improved synthetic resin packed coil assembly referred to above, which is not liable to crack formation even though subjected to a severe condition or electric load.

A further object of the present invention is to provide an improved synthetic resin packed coil assembly referred to above, which therefore exhibits an excellent electric property and a relatively high temperature reistance and which is accordingly acceptable in performance.

These and other objects and features of the present invention will become apparent from the following description taken in conjunction with preferred embodiments thereof with reference to the accompanying drawings, in which.

Figure 1:
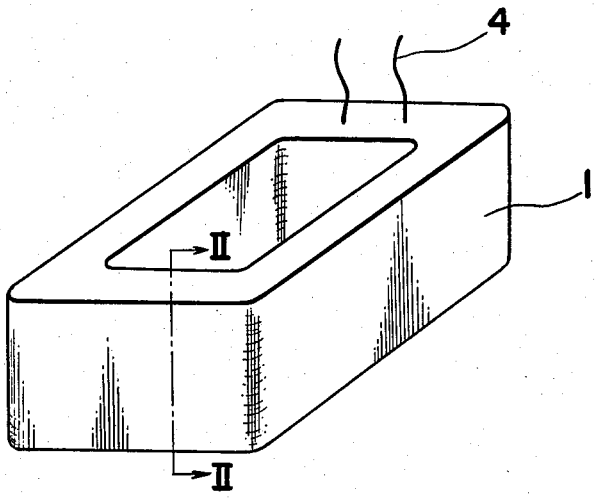
FIG. 1. PRIOR ART
FIG. 1 is a perspective view of the prior art coil assembly.
Figure 2:
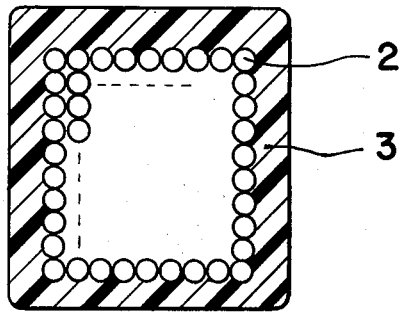
FIG. 2. PRIOR ART
FIG. 2 is a cross sectional view, on an enlarged scale, taken along the line II—II in FIG. 1, reference to FIGS. 1 and 2 having already been made in the foregoing description.
Figure 3:
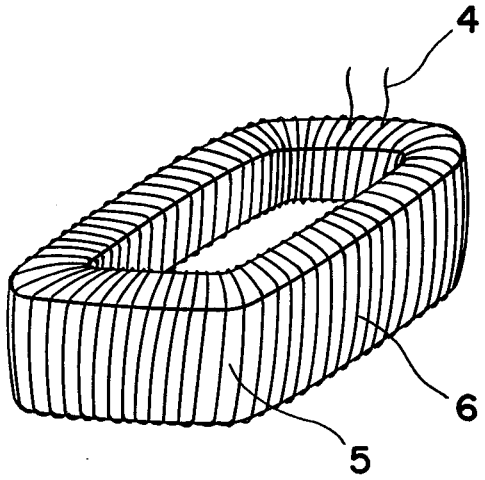
Figure 4:
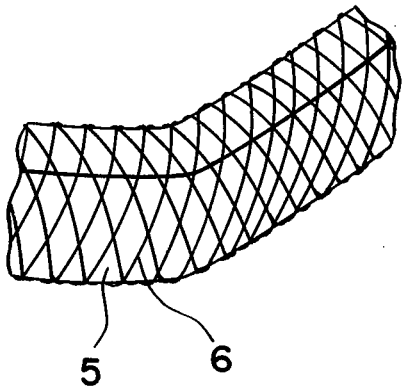
Figure 5:
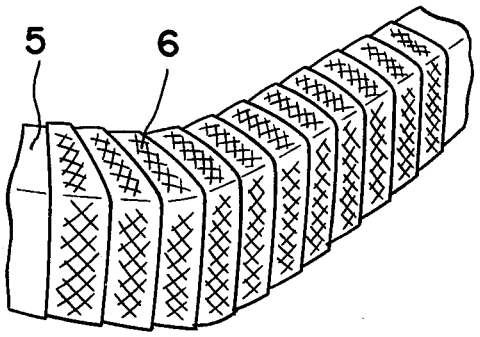
Figure 6:
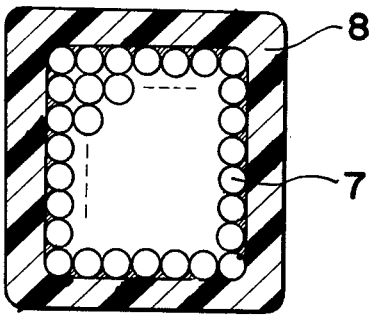
Figure 7:
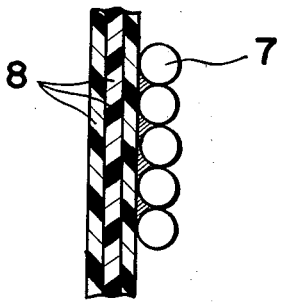
Figure 8:
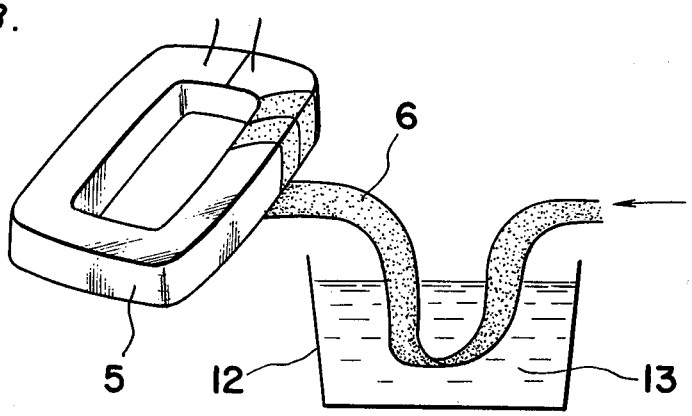
Figure 9:
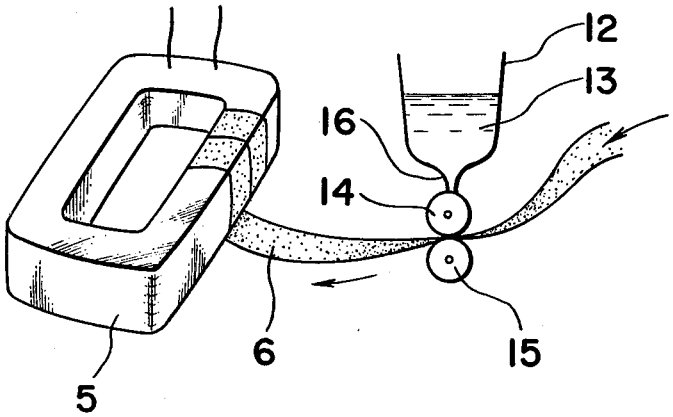

FIGS. 3 to 5 illustrate various methods of winding a thread of high strength fibrous material around a wound spiral of turns of electrical insulated wire, wherein FIG. 3 is a view similar to FIG. 1 showing the thread of high strength fibrous material being wound to form substantially parallel turns thereof, FIG. 4 is a perspective view of a portion of the coil assembly showing the thread of high strength fibrous material being wound to form substantially crossed turns and FIG. 5 is a view similar to FIG. 4 showing a tape of high strength fibrous material being wound to form substantially overlapping turns;

FIG. 6 is a view similar to FIG. 2, showing a cross sectional representation of the coil assembly according to the present invention;

FIG. 7 is a cross sectional view of a portion of FIG. 6 shown on an enlarged scale, showing the formation of a multilayer of synthetic resin;

FIGS. 8 and 9 illustrate different methods of making a coil assembly according to the present invention; and FIGS. 10 to 14 illustrate cross sectional representations of various coil assemblies according to the present invention.

Before the description of the present invention proceeds, it should be noted that like parts are designated by like reference numerals throughout the accompanying drawings.

Referring first to FIGS. 3 to 5, reference numeral 5 represents a wound spiral having a plurality of turns of insulated wire. Reference numeral 6 represents a wound high strength fibrous material such as a glass roving.

The high strength fibrous material may be toroidally wound around the bundled turns 2 of the wound spiral 5 to form substantially parallel turns such as shown in FIG. 3, or may be wound around the bundled turns 2 of the wound spiral 5 to form substantially crossing turns such as shown in FIG. 4. The high strength fibrous material may be employed in the form of a continuous tape, in which case the tape of the high strength fibrous material 6 is wound around the bundled turns of the wound spiral 5 to form substantially overlapping turns such as shown in FIG. 5. In practice, a combination of the methods of FIGS. 3 and 4, or of FIGS. 3 and 5, or of FIGS. 4 and 5, or of all of FIGS. 3 to 5 can be employed. Alternatively, turns of the high strength fibrous material 6 may extend in parallel relation to the direction of turns of the electric wire forming the wound spiral 5 singly or together with such turns of the high strength fibrous material 6, and may not be always limited to that shown in any of FIGS. 3 to 5, but may be selected as desired.

Where the winding of the high strength fibrous material 6 is not desired, it may be arranged around the outermost bundled turns 2 of the wire forming the wound spiral 5 so as to cause fibers of the material 6 to entangle each other. Even in this case, no reduction in performance of the resultant coil assembly according to the present invention will be appreciated.

The high strength fibrous material 6 may be selected from the group consisting of glass, carbon, boron, silica, alumina and "Kevlar" (Tradename used by Du Pont). The shape of the high strength fibrous material 6 may be in the form of a roving, such as shown in any of FIGS. 3 and 4, a tape such as shown in FIG. 5, a cloth, a non-woven cloth, a mat or the like.

The wound spiral having the bundled turns 2 around which the high strength fibrous material 6 has been provided is impregnated with synthetic resin under substantially vacuum atmosphere so as to allow the synthetic resin to penetrate into interstices among the bundled turns 2 of the wire. At the time the impregnated synthetic resin has been hardened, a layer of the synthetic resin reinforced by the high strength fibrous material so uniformly enveloped in such synthetic resin is formed around the outermost bundled turns 2 of the wire forming the wound spiral 5 with no void formed therein.

Alternatively, in order to form the electrically insulating layer of synthetic resin referred to above, any method, such as shown in FIGS. 8 and 9, respectively, may be employed wherein a synthetic resin, which has not yet been hardened, is first applied to the high strength fibrous material, the latter being subsequently wound around the outermost bundled turns of the wire of the wound spiral 1 and, finally, the synthetic resin which has been applied to the high strength fibrous material is allowed to harden. It will readily be seen that, because of the presence of the high strength fibrous material, the synthetic resin, upon having been hardened, is reinforced thereby to provide the insulating layer. The synthetic resin used in the practice of any of the methods of FIGS. 8 and 9 may, or may not, contain a filler material.

Referring now to FIG. 8, prior to the high strength fibrous material 6 being wound around the bundled turns of insulated wire forming the spiral 5, the high strength fibrous material 6 is continuously immersed in a solution of synthetic resin, accommodated in a container 12, to apply the synthetic resin 13 to the high strength fibrous material 6. At the time the high strength fibrous material 6 is wound around the bundled turns of insulated wire forming the wound spiral 5, the high strength fibrous material 6 is held under a predetermined tension to allow excessive synthetic resin and voids contained in the synthetic resin 13 to be removed. According to this method of FIG. 8, the high density insulating layer 8 of synthetic resin can be formed around the bundled turns of wire forming the wound spiral 5.

In the method shown in FIG. 9, at the time of winding of the high strength fibrous material 6 around the bundled turns of wire of the wound spiral 5, the high strength fibrous material 6 is fed through a pair of juxtaposed rolls 14. One of the juxtaposed rolls 14 which is rotatably supported above the other is positioned below a nozzle at the bottom of a container 12 for a solution of synthetic resin so that the latter can be supplied onto the upper roll 14 through the nozzle 16. In this arrangement, it will readily be understood that the solution of synthetic resin is applied to the high strength fibrous material 6 through the rolls 14. By adequately adjusting the clamping force exerted by the juxtaposed rolls 14 on the high strength fibrous material 6 passing therethrough, the high strength fibrous material 6 can be moved under a predetermined tension and subsequently wound around the bundled turns of wire of the wound spiral 5 to form the high density insulating layer 8 of synthetic resin. In a manner substantially similar to the method of FIG. 8, because of the tension imparted on the high strength fibrous material 6 during the winding operation, excessive resin and voids contained in the synthetic resin applied to the high strength fibrous material 6 can advantageously be removed.

However, complete removal of the voids which may otherwise be left in the insulating layer 8 would be difficult without, for example, the tension of the high strength fibrous material 6 being adequately controlled. In such a case it is recommended to carry out the winding operation of the high strength fibrous material 6 to which the synthetic resin has already been applied, under a substantially vacuum atmosphere to ensure a complete removal of the voids.

Other methods of winding the high strength fibrous material having a solution of synthetic resin applied thereto can be contemplated. One of the methods that can be contemplated is that the synthetic resin is applied to the high strength fibrous material by fusing, by the application of heat, a synthetic resin which is solid under ambient temperature and subsequently allowing it to harden after the high strength fibrous material with the synthetic resin applied thereto has been wound around the bundled turns of wire of the wound spiral 5. Another one of the methods that can be contemplated is that the synthetic resin, after having been mixed with a hardening agent, is applied to the high strength fibrous material 6 and is subsequently allowed to assume a substantially semi-cured or semi-hardened state.

A cross sectional representation of the bundled turns of wire of the wound spiral 5 forming the resin packed coil assembly according to the present invention is shown in FIG. 6 wherein reference numeral 7 represents the bundled turns of wire of the wound spiral 5 and reference numeral 8 represents the insulating layer 8 formed in the manner as hereinbefore described.

In FIG. 7, the insulating layer 8 is depicted as composed of a plurality of, for example, three plies.

According to the present invention, since the insulating layer 8 is composed of the synthetic resin, having a thermal expansion coefficient greater than that of the wire of the wound spiral 5, and the high strength fibrous material, such as glass, having a thermal expansion coefficient smaller than the wire of the wound spiral 5, the thermal expansion coefficient of the resultant insulating layer 8 can be rendered substantially equal to or approximate to that of the wire of the wound spiral 5. Although, during the use of the coil assembly in the external circuit, stress set-up may take place in the insulating layer 8 if there is a difference in thermal expansion coefficient, the insulating layer 8 composed of the synthetic resin reinforced by the high strength fibrous material exhibits a highly improved physical strength, even when subjected not only to a relatively low temperature and an ambient temperature, but also to a higher temperature than the heat distortion temperature of the synthetic resin used, and, therefore, no substantial cracks occur in the insulating layer 8. By way of example, where glass rovings and epoxy resin are respectively employed for the high strength fibrous material 6 and the synthetic resin which is applied to the fibrous material 6, the physical strength of the resultant insulating layer 8 is about 5 times at an ambient or room temperature and about 15 times at 150 to 200° C. with respect to the physical strength exhibited by an insulating layer which is prepared solely from the epoxy resin with no high strength fibrous material added thereto.

Furthermore, according to the present invention, since the insulating layer 8 of the sufficiently high physical strength as described above can be obtained in the construction of the coil assembly shown in any of FIGS. 6 and 7, the concept of the present invention can be applicable to manufacturing a highly reliable coil assembly which can satisfactorily be operated in a highly power-loaded external circuit, which has a relatively high temperature resistance and which accordingly is compact in size.

In addition to the foregoing features, since the synthetic resin of low viscosity can be employed during the manufacture of the coil assembly according to the present invention, the required time to carry out the impregnation process can advantageously be shortened with no substantial flaws, such as resulting from the presence of voids, appearing in the resultant coil assembly.

According to either of the methods, wherein the high strength fibrous material, after having been wound around the bundled turns 7 of wire of the spiral 5, is impregnated with synthetic resin, or wherein the high strength fibrous material, after having been applied with a solution of synthetic resin, is wound around the bundled turns 7 of wire of the spiral 5, the insulating layer 8 wherein the high strength fibrous material is present in an entangled form of long fibers and is uniformly distributed can easily be obtained, completely around the bundled turns 7 of wire of the wound sprial 5.

As hereinbefore described, the coil assembly of the construction shown in FIG. 6 is excellent in performance. However, during the manufacture thereof, it has been found that there is a possibility that the bundled turns 7 of wire of the wound spiral 5 are not completely bonded to the insulating layer 8 of synthetic resin reinforced by the high strength fibrous material and that an electrically insulating layer solely composed of the synthetic resin is consequently formed between the bundled turns 7 and the insulating layer 8. This is particularly true where the bundled turns 7 of wire of the wound spiral 5 represents a rectangular or square cross section and, since the high strength fibrous material insufficiently fills up the interstices among the bundled turns of wire of the wound spiral 5 if the wire has a circular cross sectional shape, only the synthetic resin is penetrated into the interstices thereby forming an electrically insulating layer.

On the other hand, while the thermal expansion coefficient of the electric wire prepared from aluminum and that of the electric wire prepared from copper are respectively about $2.2 \times 10^{-5}$ and $1.6 \times 10^{-5}$ cm/cm/° C., the thermal expansion coefficient of, for example, epoxy resin, is $5 \times 10^{-5}$ cm/cm/° C. at room temperature and $5 \times 10^{-4}$ cm/cm/° C. at 150 to 200° C. Accordingly, if the layer of only the synthetic resin is formed in the manner as hereinbefore described, considerable stresses will be set up in such resin layer as the temperature increases during the use of the coil assembly, which stresses are liable to formation of cracks. Once these cracks occur in the resin layer, corona discharge occurs at portions of the resin layer where the cracks are formed upon application of a relatively high voltage to the coil assembly and, therefore, the durability of the coil assembly is reduced.

Figure 10:
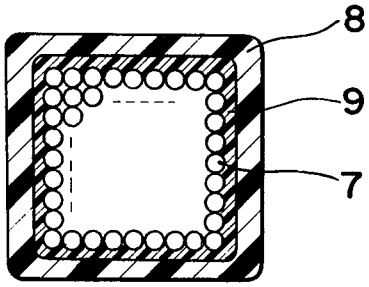
Figure 11:
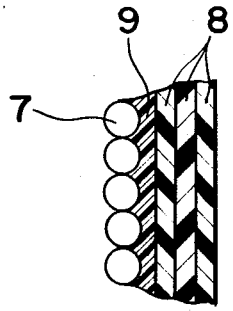

The foregoing problem can be advantageously solved according to any of embodiments of the present invention shown in FIGS. 10 and 11, respectively.

With particular reference to FIG. 10, between the insulating layer 8 of synthetic resin reinforced by the high strength fibrous material and the bundled turns 7 of wire of the wound spiral 5, there is formed an intermediate insulating layer 9 having a relatively low thermal expansion coefficient, for example, approximate to the thermal expansion coefficient of the electric wire used to form the wound spiral 5. According to a series of experiments, it has been found that the intermediate layer 9 is preferred to have a thermal expansion coefficient of not more than $4 \times 10^{-5}$ cm/cm/° C.

Material for the intermediate insulating layer 9 may be a snythetic resin admixed with an inorganic insulating substance or a filler of such inorganic material as silica, alumina, hydrated alumina, calcium carbonate, magnesia, talc, clay, titanium oxide, mica, glass and so on. The synthetic resin admixed with the inorganic insulating material or the inorganic material as the filler cannot be satisfactorily used to form an outermost covering for the bundled turns of wire of the wound spiral. However, in the present invention, since the synthetic resin admixed with the inorganic insulating material or the inorganic material as the filler is used as a material for the intermediate insulating layer 9 disposed between the bundled turns 7 of wire of the wound spiral 5 and the insulating layer 8, the layer 9 may have a relatively small thickness. This is possible because the insulating layer 8 acts as a primary insulator and, concurrently, the outermost protective covering.

In view of the thickness of the intermediate layer 9 being small, the intermediate insulating layer 9 is so deformable following the stresses set up therein, so low in thermal expansion coefficient and so less liable to formation of cracks that a highly reliable coil assembly can be manufactured according to the present invention.

As a method for forming the intermediate insulating layer 9, any known fluidized bed technique, electrostatic fluidized bed technique, spray technique or electrostatic spray technique can be employed. In the practice of any of these known techniques, the resin admixed with the inorganic insulating material or the inorganic material as the filler is applied in the form of a powder and, accordingly, the intermediate insulating layer 9 of uniformly small thickness can readily be formed around the bundled turns 7 of wire of the wound spiral 5. Preferably, the synthetic resin material for the layer 9 contains the inorganic material as the filler as hereinbefore described. The synthetic resin material for the layer 9 may be epoxy resin, polyester resin or the like, and manufacture of the coil assembly according to the present invention, wherein the intermediate layer 9 is prepared from the synthetic resin with the inorganic insulating material contained therein, or with the inorganic material contained therein as the filler, can automatically be carried out with no substantially complicated procedures involved.

The intermediate insulating layer 9, even though it is a layer of relatively small thickness, having a sufficiently high physical strength and being so deformable as to follow the internal stresses, is less liable to formation of cracks therein. Accordingly, even in the coil assembly of the construction shown in FIG. 10, the above described advantages can be appreciated. By way of example, according to a series of experiments it has been found that the synthetic resin material of not less than 8 $kg/mm^2$ in bending strength and not less than 5% in elongation is more suited as a material for the intermediate insulating layer 9. Examples of the synthetic resin material for the insulating layer 9 may include a compound with metallic material and rubber or rubber-like material.

If as a material for the intermediate insulating layer 9 a porous material is employed, the synthetic resin can, during the impregnation process, penetrate into the pores of the material forming the layer 9 to fill the pores and, therefore, the level at which corona discharge takes place and the impulse surge in the resultant coil assembly can advantageously be improved. It is to be noted that the synthetic resin which has penetrated into the pores of the material forming the intermediate layer 9 is subsequently hardened and, therefore, if such a porous material is used which, when hardened, exhibits a relatively low thermal expansion coefficient, a relatively high physical strength or a relatively high elongation, the layer 9 composed of such synthetic material can serve as an insulator.

On the other hand, if the intermediate layer 9 can exhibit a property similar to a semi-conductor having an appropriate resistance, no substantial potential difference will be created in the layer 9 even if the latter has voids and/or cracks therein, and corona discharge will hardly occur. In the embodiment shown in FIG. 12, while the intermediate layer 9 serves as an insulator, a semi-conductive or conductive layer 10 is formed between the layer 9 and the layer 8 composed of the synthetic resin reinforced by the high strength fibrous material as hereinbefore described. In this construction as shown in FIG. 12, since the semi-conductive layer 10 does not directly contact the outermost turns of the bundled turns 7 of wire of the wound spiral 5, not only the leakage potential level at the outermost turns of the bundled turns 7 can advantageously be minimized, but also an effect of relief of the electric field of the semi-conductive layer 10 can be expected as hereinbefore described.

Figure 13:
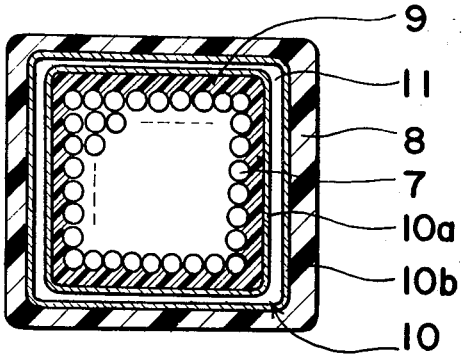

In the embodiment shown in FIG. 13, a bare coil constituted by winding wires is coated with epoxy resin in the form of a powder by means of fluidization dip coating to form the intermediate insulating layer 9, onto which a powdered resin of a semi-conductive material is applied for forming semi-conductive layer **10*a*. A mold release agent is then applied over the surface of semi-conductive layer 10*a*. The release agent may be, for example, a silicone resin such as DC23 or DCR-671 (used in trade and manufactured by DOW Corning Company of U.S.A.) or a silicone oil, as applied onto a metal mold, for producing cast molded resinous articles, prior to casting the resin. Alternatively, the release agent may be Teflon (used in trade and manufactured by E.I. du Pont de Nemours & Co., Inc. of U.S.A.). Thus, the thin film of the release agent is formed on the external surface of the semi-conductive layer 10*a*. Thereafter, a semi-conductive tape is wound about the assembly to form semi-conductive layer 10*b*. After winding a high strength fibrous material around this assembly, the resultant coil is impregnated with a resin and then hardened. During hardening of the resin, a small air gap or space like a layer is formed as a result of contraction of the resin, due to the presence of the layer of the release agent between semi-conductive layers 10*a* and 10*b*. In other words, the presence of the release agent, combined with curing of the resin, results in formation of an air gap layer. It is to be noted that, after the resin has been poured into the metal mold which has been treated with the release agent, subsequent curing of the resin results in contraction of the resin upon hardening, and as a result of this contraction, a small gap or space is formed between the surface of the release agent and the resin to facilitate removal of the hardened resin from the mold. If a metal mold is used without the release agent, the gap is not formed, due to adhesion of the resin to the mold surface. In the present invention, this concept of using a release agent can be employed to form the air gap layer between semi-conductive layers 10*a* and 10*b*** by means of the release agent.

Still referring to the embodiment shown in FIG. 13, the semi-conductive or conductive layer 10 is composed of inner and outer semi-conductive or conductive plies **10*a* and 10*b* and a gap layer 11 located between the outer and inner plies 10*a* and 10*b*. Material for the inner and outer plies 10*a* and 10*b* and, therefore, the layer 10 may be any conductive material, such as carbon, a sheet containing carbon, a metallic compound or a metal, or synthetic resin containing the conductive material. During the operation of the coil assembly of the construction shown in FIG. 13, since the potential of either of the inner and outer plies 10*a* and 10*b* is substantially equalized to that of the other of the inner and outer plies 10*a* and 10*b* over the outermost turns of the bundled turns 7 of wire of the wound spiral 5, no potential difference is substantially created in the gap layer 11 and, therefore, no corona discharge occurs. Another advantage resulting from the provision of the gap layer 11 is that the gap layer 11 absorbs variation in volume of any of the inner and outer plies 10*a* and 10*b*** which may result from variation of the ambient temperature, variation of the operating temperature of the coil assembly and/or variation in dimension due to aging, and that the internal stresses can, therefore be relieved.

Figure 12:
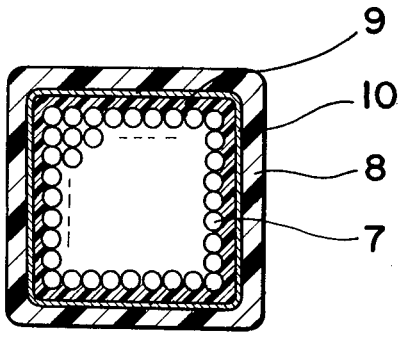

With the construction shown in FIG. 13, in addition to the internal stress relief achieved in the manner as hereinbefore described, the effect of electric field relief can also be attained in a manner similar to the construction shown in FIG. 12.

Still referring to FIG. 13, the inner and outer plies 10a and 10b of the semi-conductive or conductive layer 10 are preferably firmly bonded to the intermediate layer 9 and the synthetic resin layer 8, respectively. A layer of a release agent, and a gap layer (void or air space), are disposed between plies 10a and 10b. As indicated above, this can be achieved by applying a synthetic resin, such as a semi-conductive powdery synthetic resin, to the outer peripheral surface of the layer 9, subsequently applying, or otherwise lining, a release agent such as silicone oil, silicone resin or tetrafluoroethylene over the applied synthetic resin, thereafter winding the high strength fibrous material after a semi-conductive material, such as a carbon sheet, has been wound around the applied synthetic resin, and finally hardening the synthetic resin material after the assembly has been dipped in a solution of the synthetic resin material.

The gap layer 11 herein referred to is not of a type having a uniform thickness between the inner and outer plies 10a and 10b and, in other words, is not chemically bonded to any of the inner and outer plies 10a and 10b. In practice, this gap layer 11 allows the inner and outer plies 10a and 10b of the semi-conductive or conductive layer 10 to contact each other at local positions and, accordingly, during the operation of the coil assembly, the plies 10a and 10b are charged with substantially equal potential.

While the employment of the plies 10a and 10b are preferred, either the inner ply 10a or the outer ply 10b may be omitted if the gap layer 11 is sufficiently small in thickness.

Figure 14:
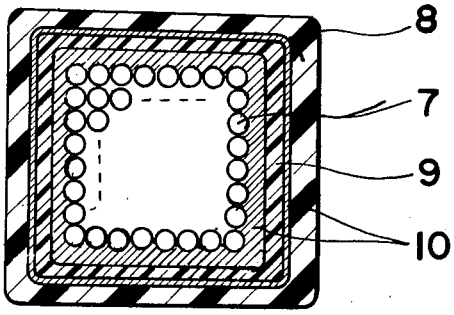

If in the construction shown in any of FIGS. 12 and 13 the wire forming the bundled turns 7 of the wound spiral 5 is highly insulated, or if the induced voltage between one layer and another of the coil assembly is sufficiently low, there may be provided the semi-conductive layer 10 between the bundled turns 7 of wire of the wound spiral 5 and the layer 9 such as shown in FIG. 14. In this case, even if the insulated wire forming the bundled turns 7 of the wound spiral 5 does not exhibit a sufficient bondability with respect to the material of the layer which is held in contact therewith, the effect of electric field relief can be attained by the semi-conductive layer 10 between the bundled turns 7 and the layer 9.

The insulated wire employed to form the electromagnetic coil assembly of any of the constructions shown in FIGS. 3 to 14 is preferably employed in the form of a self-fusible wire, that is, a wire sheathed with a thermoplastic material. If this type of wire is employed and subsequently coiled to form the bundled turns 7, the bundled turns 7 can easily be obtained with one turn firmly bonding to adjacent turns upon application of heat thereto. Therefore, an auxiliary element, such as a temporarily binding tape, is not required to retain the shape of the bundled turns 7 of wire of the wound spiral 5 prior to the formation of the layer to be contacted to the outermost turns of the bundled turns 7 of wire of the wound spiral 5. Furthermore, since an insulating sheet between the layers can be removed, the electromagnetic coil assembly, compact in size, can effectively and readily be manufactured at a high production rate.

Although the present invention has been fully described by way of the preferred embodiments thereof, it should be noted that various changes and modifications are apparent to those skilled in the art. Such changes and modifications, unless they depart from the true scope of the present invention, should be construed as included therein.

We claim:

1. A synthetic resin packed coil assembly which comprises a wound spiral of a plurality of bundled turns of insulated wire, a first layer of high strength fibrous material impregnated with a synthetic resin, said first layer forming the outer periphery of said synthetic resin packed coil assembly, an intermediate insulating layer disposed between said wound spiral and said first layer, and a semi-conductive layer disposed between said intermediate insulating layer and said first layer, said semi-conductive layer being constituted by a first ply firmly bonded to said intermediate insulating layer and a second ply firmly bonded to said first layer, there being a layer of a release agent and an air-gap layer disposed between said first and second plies.

2. A synthetic resin packed coil assembly as claimed in claim 1, wherein said intermediate insulating layer is a mixture of a synthetic resin and a member selected from the group consisting of silica, alumina, hydrated alumina, calcium carbonate, magnesia, talc, clay, titanium oxide, mica and glass.

3. A synthetic resin packed coil assembly as claimed in claim 1, wherein said semi-conductive layer is selected from the group consisting of carbon, a sheet containing carbon, a metallic compound, and a metal, or a synthetic resin containing a member selected from the group consisting of carbon, a metallic compound and a metal.

4. A synthetic resin packed coil assembly as claimed in claim 1, wherein said intermediate insulating layer has a thermal expansion coefficient of not more than $4 \times 10^{-5}$ cm/cm/° C at ambient temperature.

5. A synthetic resin packed coil assembly as claimed in claim 1, wherein said intermediate insulating layer is a resinous layer containing an inorganic material.

6. A synthetic resin packed coil assembly as claimed in claim 1, wherein said intermediate insulating layer is one formed by applying powdery resinous material onto the surface of said wound spiral.

7. A synthetic resin packed coil assembly as claimed in claim 1, wherein said intermediate insulating layer is one prepared from a synthetic resinous material having a bending strength of not less than 8 kg/mm$^2$.

8. A synthetic resin packed coil assembly as claimed in claim 1, wherein said intermediate insulating layer is one prepared from a synthetic resinous material having an elongation of not less than 5%.

9. A synthetic resin packed coil assembly as claimed in claim 1, wherein said fibrous material is selected from the group consisting of glass, carbon, boron, silica and alumina.

* * * * *